United States Patent [19]

Sauer et al.

[11] Patent Number: 4,905,763

[45] Date of Patent: Mar. 6, 1990

[54] METHOD FOR SERVICING OFFSHORE WELL

[75] Inventors: Carl W. Sauer, Stavanger, Norway; Michael P. Stockinger, Missouri City, Tex.; Larry K. Moran, Ponca City, Okla.

[73] Assignee: Conoco Inc., Ponca City, Okla.

[21] Appl. No.: 294,335

[22] Filed: Jan. 6, 1989

[51] Int. Cl.[4] ..... E21B 33/072; E21B 33/076

[52] U.S. Cl. ..... 166/336; 166/253; 166/385; 166/387

[58] Field of Search ..... 166/336, 337, 77, 84, 166/385, 55.1, 55, 250, 65.1, 253, 387, 70

[56] References Cited

U.S. PATENT DOCUMENTS 3,415,317 12/1968 Drivet ..... 166/336

3,556,209 1/1971 Reistle, III ..... 166/84 X

*Primary Examiner*—Stephen J. Novosad

*Attorney, Agent, or Firm*—Richard W. Collins

[57] ABSTRACT

A method for servicing an offshore well having a subsea blowout preventer. A sealing nipple having a wireline extending therethrough and connected to a servicing tool is lowered into the well and sealed by sealing rams of the blowout preventer. After the sealing rams are closed about the sealing nipple, the well can be pressurized through a fluid line extending to a work area. The method is particularly useful for pressurizing a cased well to eliminate any microannulus between the well casing and cement surrounding the casing prior to running a cement evaluation logging tool through the well.

1 Claim, 2 Drawing Sheets

METHOD FOR SERVICING OFFSHORE WELL

BACKGROUND OF THE INVENTION

This invention relates to servicing of offshore wells, and particularly to servicing of wells having subsea blowout preventer stacks.

The use of subsea blowout preventer stacks during drilling and completion of offshore wells is common. Typically, such wells are lined with one or more strings of casing as drilling of the well progresses, and the casing is cemented in place by injection of cement into the annulus between the casing string and the borehole wall. Prior to completing the well, particularly in cases where the well penetrates more than one potential producing formation, it is important to evaluate the cement job to determine if multiple formations are isolated by the casing cement. If there are voids in the cement column then undesirable flow communication between formations can occur.

Cement jobs are evaluated by running an acoustic pulse transmitter logging tool through the wellbore to determine whether the annulus between the casing and the borehole wall is full of cement. If not, the casing may have to be perforated adjacent the void areas and the voids filled by squeezing cement through the perforations. Such operations are routine, but nevertheless are costly.

When cement in a wellbore annulus sets, it often generates sufficient heat to slightly expand the casing, which on cooling contracts away from the cement to create a "microannulus". This microannulus does not normally cause production problems, but it can cause a false indication of a cement job failure due to poor acoustic coupling between the cement and casing during the cement evaluation logging procedure.

In servicing an onshore well, it is possible to pressurize the wellbore sufficiently to eliminate the microannulus and provide good acoustic coupling during the logging step. Typically a "lubricator" is attached to the blowout preventer and a wireline connected to a logging tool is lowered from the lubricator through the wellbore. The lubricator enables the well to be pressurized to eliminate any microannulus that otherwise would interfere with the logging.

Unfortunately, in subsea completions where a riser extends from a subsea blowout preventer to a work area on a fixed or floating offshore platform, it is not feasible to use a lubricator and to pressurize the wellbore using techniques suitable for onshore wells.

In some subsea completion cases, a cement evaluation log is simply run on the unpressurized well, and if a void area is indicated, then a cement squeeze is performed, even though the void indication may actually have resulted from a microannulus rather than from an actual void. This results in unnecessary squeeze jobs, with resulting costs and lost production. There has been a continuing need for an improved procedure for running cement evaluation logs in offshore wells having subsea blowout preventers.

SUMMARY OF THE INVENTION

According to the present invention, a method is provided for pressurizing an offshore wellbore during servicing of the wellbore. The method is particularly appropriate for running cement evaluation logs in wells that have been cased and cemented, but not yet placed in production. Such wells have no direct flow channel to the formation, and can be pressurized simply by pumping fluid into the wellbore below a closed blowout preventer seal. Typically a "kill line" extends from a platform working area to a valved opening below the blowout preventer seal.

In order to seal the wellbore at the blowout preventer, a sealing nipple is lowered from the working area to a position adjacent sealing rams in the blowout preventer, and the sealing rams are closed about the sealing nipple. A logging tool attached to a wireline extending through a packing means in the sealing nipple can then be run through the wellbore after the wellbore is pressurized, by fluid from the kill line, to a pressure sufficient to eliminate any microannulus between the casing and cement surrounding the casing.

It is an object of the invention to provide an improved method for servicing an offshore well having a subsea blowout preventer.

It is a further object to provide an improved method for running a cement evaluation log in an offshore well having a subsea blowout preventer.

It is a still further object of the invention to provide a method for eliminating the microannulus between a well casing and cement surrounding the casing during the running of a cement evaluation log.

The foregoing as well as additional objects and advantages are obtained by the present invention as will be apparent from consideration of the following detailed description thereof.

DRAWINGS

DESCRIPTION OF THE PREFERRED EMBODIMENTS

Figure 1:
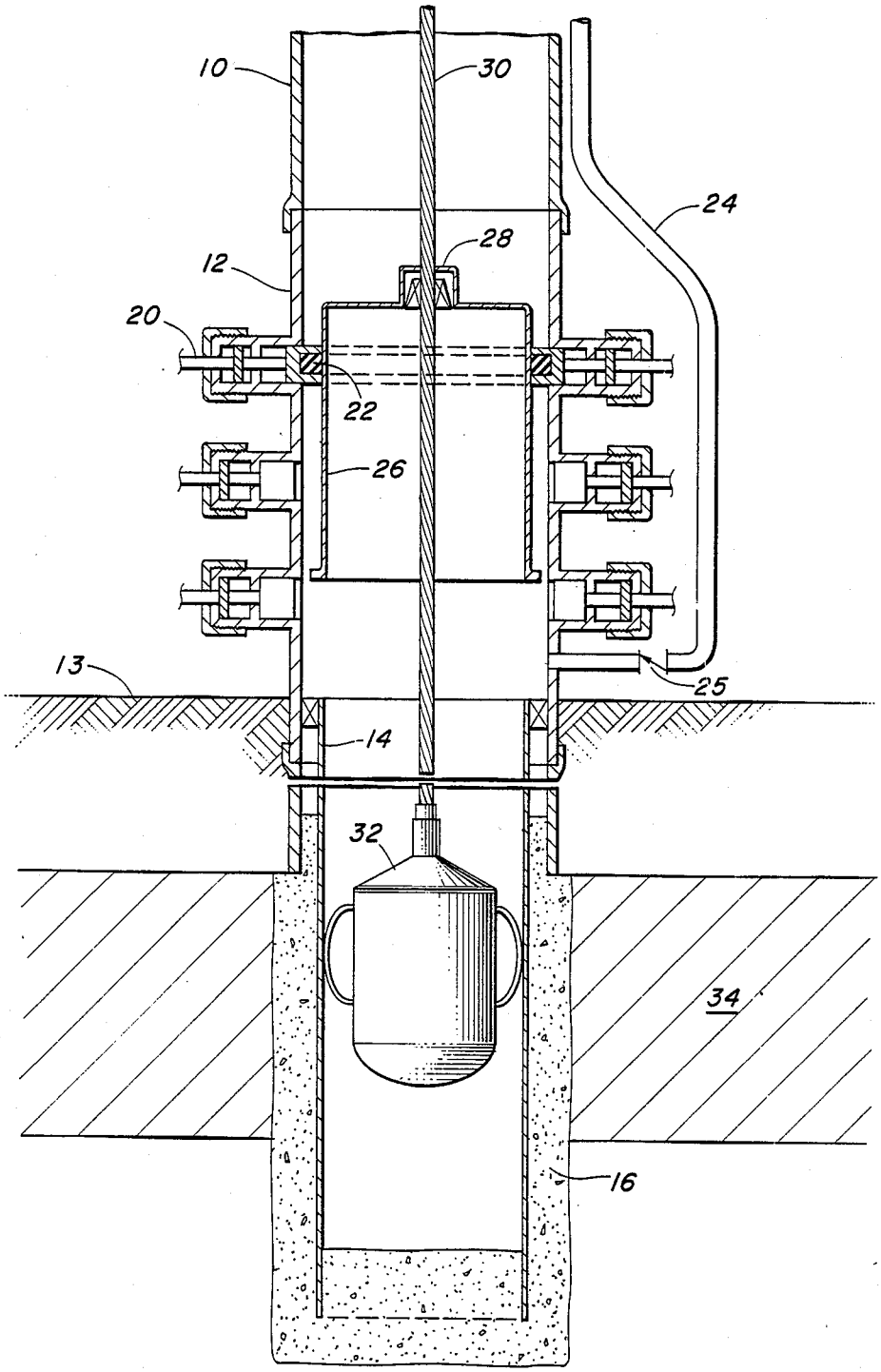
FIG. 1 is a cross-sectional view (not to scale) illustrating a sealed subsea wellbore in accordance with the invention.

Referring to FIG. 1, a riser 10 extends from a work area (not shown) on an offshore platform to a blowout preventer stack 12 located at or near the mudline 13. A casing string 14 extends from blowout preventer 12 to the bottom of a borehole, and is cemented in place by cement 16 between the borehole wall 18 and the outer surface of casing 14.

Blowout preventer 12 includes a set of sealing rams 20 operable to close an elastomeric seal 22 about a pipe section or tool located in the blowout preventer adjacent seals 22. A kill line 24 extends from the work area to a valve 25 and then into an opening in the blowout preventer stack below the sealing rams, so that if seal 22 is closed about a pipe or tool and the pipe or tool is closed above the seal, then the well below the blowout preventer can be pressurized through kill line 24.

As seen in FIG. 1, a sealing nipple 26 is positioned adjacent seal 22 and is closed at its top except for a wireline seal or stuffing box 28 adapted to provide a pressure seal against wireline 30 slidably extending from the work area through sealing means 28 into the well below blowout preventer 12 and attached to a logging tool 32.

Figure 2:
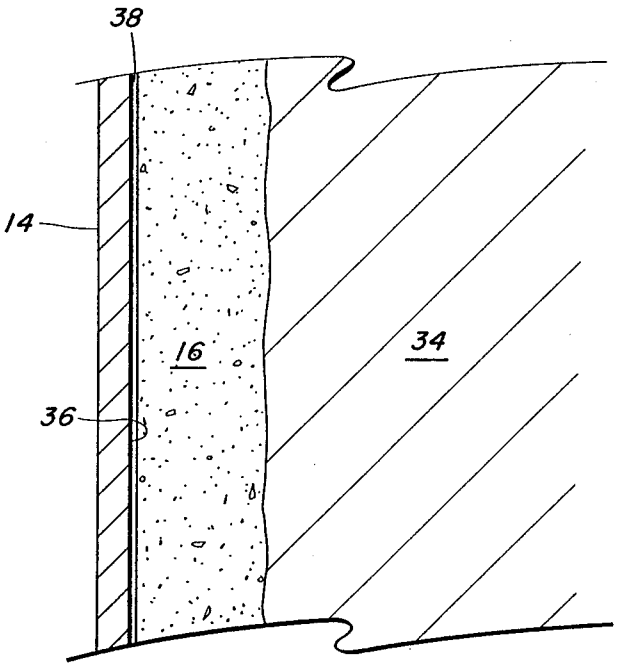
FIG. 2 is a sectional view illustrating (in exaggerated scale) a microannulus between a well casing and cement.

Referring to FIG. 2, cement 16 fills the space between formation 34 and the outer wall 36 of casing 14. Shown in exaggerated scale is a gap or microannulus 38 as can result from shrinkage of casing 14 away from cement 16 as the heat of setting of cement 16 is dissipated. This gap can cause false indications of cement voids during cement evaluation logging, as discussed previously.

Figure 3:
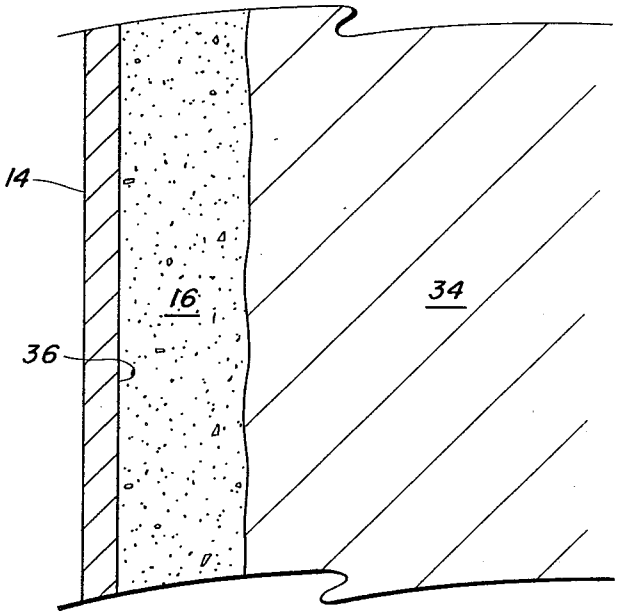
FIG. 3 is a sectional view similar to FIG. 2 but showing the microannulus as eliminated from pressure in the casing.

In accordance with the most preferred embodiment of the invention, this microannulus can be eliminated, as illustrated in Figure 3, prior to running cement evaluation log. Referring again to FIG. 1, a logging tool 32 is attached to wireline 30 extending through sealing nipple 26 and stuffing box 28, and the assembly is lowered through the open blowout preventer stack until sealing nipple 26 is adjacent seal 22. Sealing rams 20 are then actuated to close seal 22 about sealing nipple 26. The wellbore is then pressurized by application of fluid through kill line 24 to a pressure sufficient to expand casing 14 against the inner wall of cement 16 to eliminate any microannulus between casing 14 and cement 16. Depending on casing diameter and thickness, cement formulation, well conditions, etc., a pressure at the work area of from about 500 to about 5,000 psi, typically about 1,000 psi is appropriate. Logging tool 32 is then traversed through the wellbore to generate data indicative of the quality of the cement job. Upon completion of the logging run, the wellbore is depressurized, sealing rams 20 are actuated to move seal 22 away from sealing nipple 26, and the assembly is removed from the borehole up through riser 10 to the work area. The well can then be completed in a normal manner, or if the logging operation indicated a discontinuity in the cement, then a cement squeeze can be performed prior to completing the well.

The method of the invention, in another embodiment, can be used to perform well treatments other than cement evaluation logging. For example, a perforating gun (not shown) could be attached to wireline 30 instead of the logging tool. The operation would be essentially the same as described for the logging step, except that it may not be necessary to pressurize the wellbore.

Additional variations and modifications within the scope of the invention will be apparent to those skilled in the art.

We claim:

1. A method of servicing a cased offshore well having a subsea blowout preventer stack and a riser extending from said stack to an above-water work area, said blowout preventer stack including sealing rams, said method comprising:

(a) running a sealing nipple, which is open at its lower end and closed at its upper end except for a wireline packing means and which has a wireline extending through said wireline packing means, from said work area down through said riser into said blowout preventer stack to a position adjacent said sealing rams, said wireline being attached to a cement bond logging tool extending below said sealing nipple;

(b) closing said sealing rams about said sealing nipple and pressurizing said well below said blowout preventer stack to a level sufficient to eliminate any microannulus between the casing of said well and cement surrounding said casing by application of fluid pressure to said well from a pressure line extending from said work area;

(c) operating said cement bond logging tool in said well;

(d) opening said sealing rams; and (e) removing said sealing nipple and cement bond logging tool from said blowout preventer stack and riser.

* * * * *